US005644957A

United States Patent [19]

Gustafson et al.

[11] Patent Number: 5,644,957

[45] Date of Patent: Jul. 8, 1997

[54] ADJUSTABLE WRENCH WITH WORM LOCKING MECHANISM

[75] Inventors: Eric T. Gustafson; Jeffrey H. Hoff, both of Kenosha, Wis.

[73] Assignee: Snap-on Technologies, Inc., Lincolnshire, Ill.

[21] Appl. No.: 567,685

[22] Filed: Dec. 26, 1995

[51] Int. Cl.[6] ..... B25B 13/16

[52] U.S. Cl. ..... 81/165; 81/170; 81/DIG. 3

[58] Field of Search ..... 81/165, 170, DIG. 3

[56] References Cited

U.S. PATENT DOCUMENTS

| | | | |
|---|---|---|---|
| 157,968 | 12/1874 | McFarland . | |
| 1,160,494 | 11/1915 | Bush . | |
| 1,599,162 | 9/1926 | Brown . | |
| 1,729,640 | 10/1929 | Vallone . | |
| 1,846,380 | 2/1932 | Anderson . | |
| 2,385,660 | 9/1945 | Truby . | |
| 2,427,608 | 9/1947 | Kershaw . | |
| 2,458,794 | 1/1949 | Ogden . | |
| 2,678,854 | 6/1954 | Kershaw | 81/165 |
| 3,024,683 | 3/1962 | Finn et al. | 81/165 |
| 4,326,436 | 4/1982 | McGraw . | |
| 4,548,104 | 10/1985 | Hendricks . | |
| 5,154,103 | 10/1992 | Lewis, Jr. . | |
| 5,301,576 | 4/1994 | Nye . | |

*Primary Examiner*—James G. Smith
*Attorney, Agent, or Firm*—Emrich & Dithmar

[57] ABSTRACT

An adjustable wrench having locked and unlocked conditions is provided. The wrench includes a wrench body including a fixed jaw, and a movable jaw slidably mounted on the wrench body. The wrench body includes first and second contact walls, the second contact wall having a wall cam surface. The wrench also includes an adjuster assembly including a worm gear on the body between the contact walls and threadedly engaged with the movable jaw for moving the movable jaw toward and away from the fixed jaw, and a locking disc disposed between the worm gear and the second contact wall and having a disc cam surface engagable with the wall cam surface of the second contact wall. The locking disc is movable by a user's finger between the locked and unlocked conditions, wherein the disc cam surface engages the wall cam surface in the locked condition for wedging the adjuster assembly and the locking disc between the first and second contact walls to substantially prevent rotation of the worm gear and movement of the movable jaw, the locking disc in the unlocked condition releasing the disc cam surface from engagement with the wall cam surface so that the worm gear is free to rotate.

21 Claims, 3 Drawing Sheets

ADJUSTABLE WRENCH WITH WORM LOCKING MECHANISM

BACKGROUND OF THE INVENTION

1. Field of the Invention

The present invention relates to adjustable wrenches and, in particular, to such constructions with jaw locking mechanisms.

2. Description of the Prior Art

Various types of adjustable wrenches with locking mechanisms to lock the position of the movable jaw of the wrench have been provided. The locking mechanisms of many of these wrenches, however, are often of multi-piece construction, are very intricate and very costly to manufacture. Also, some of these locking mechanisms are not very sturdy and often need to be replaced.

Additionally, many of these wrenches require an additional tool to operate the locking mechanism. These additional tools require additional storage space and add to a consumer's cost. Such wrenches requiring additional tools also require the use of two hands to effect the locking operation.

SUMMARY OF THE INVENTION

It is a general object of the invention to provide an improved locking adjustable wrench which avoids the disadvantages of prior wrenches while affording additional structural and operation advantages.

An important feature of the invention is the provision of a locking adjustable wrench which is of a relatively simple and economical, yet sturdy construction.

A still further feature of the invention is the provision of a wrench of the type set forth which can be easily and securely locked without the need for an additional tool.

Yet another feature of the invention is the provision of a wrench of the type set forth which can be operated and locked with only one hand.

These and other features of the invention are attained by providing an adjustable wrench having locked and unlocked conditions. The wrench includes a moveable jaw slidably mounted on the wrench body. The wrench body includes first and second contact walls, the first contact wall having a wall cam surface. The wrench also includes an adjuster assembly including a worm gear on the body between the contact walls and threadedly engaged with the movable jaw for moving the movable jaw toward and away from the fixed jaw, and a locking disc disposed between the worm gear and the first contact wall and having a disc cam surface engageable with the wall cam surface of the first contact wall. The locking disc is movable by a user's finger between the locked and unlocked conditions, wherein the disc cam surface engages the wall cam surface in the locked condition for wedging the adjuster assembly and the locking disc between the first and second contact walls to substantially prevent rotation of the worm gear and movement of the movable jaw. The locking disc in the unlocked condition releases the disc cam surface from engagement with the wall cam surface so that the worm gear is free to rotate.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
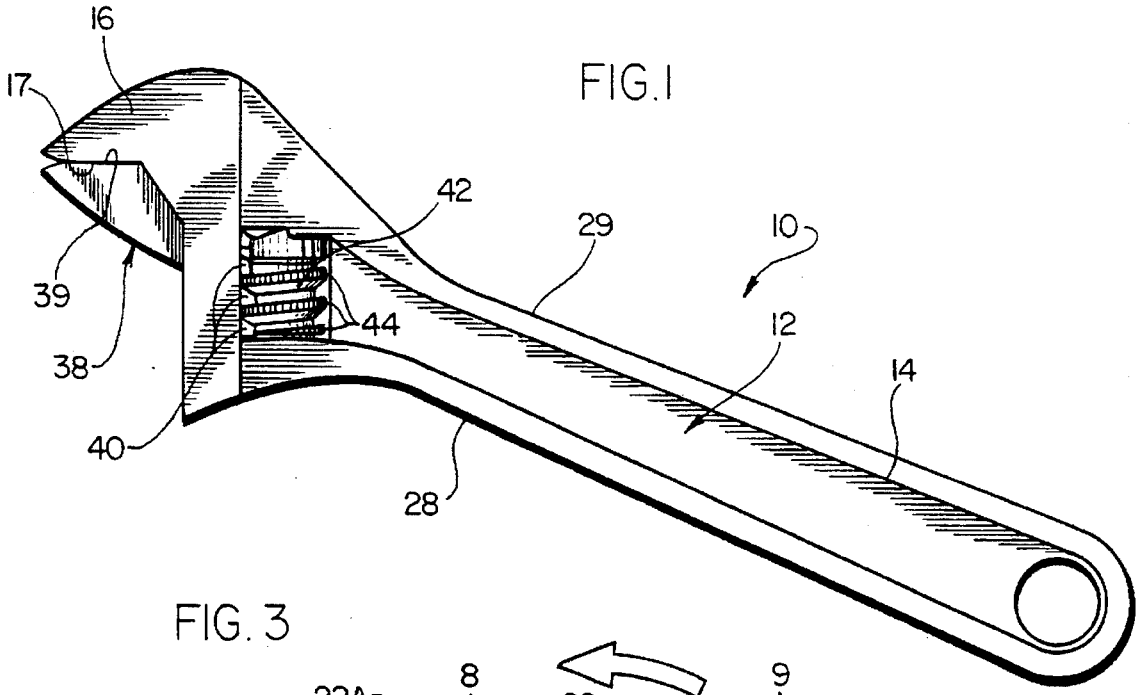
FIG. 1 is a top plan view of a locking adjustable wrench in accordance with the present invention.
Figure 2:
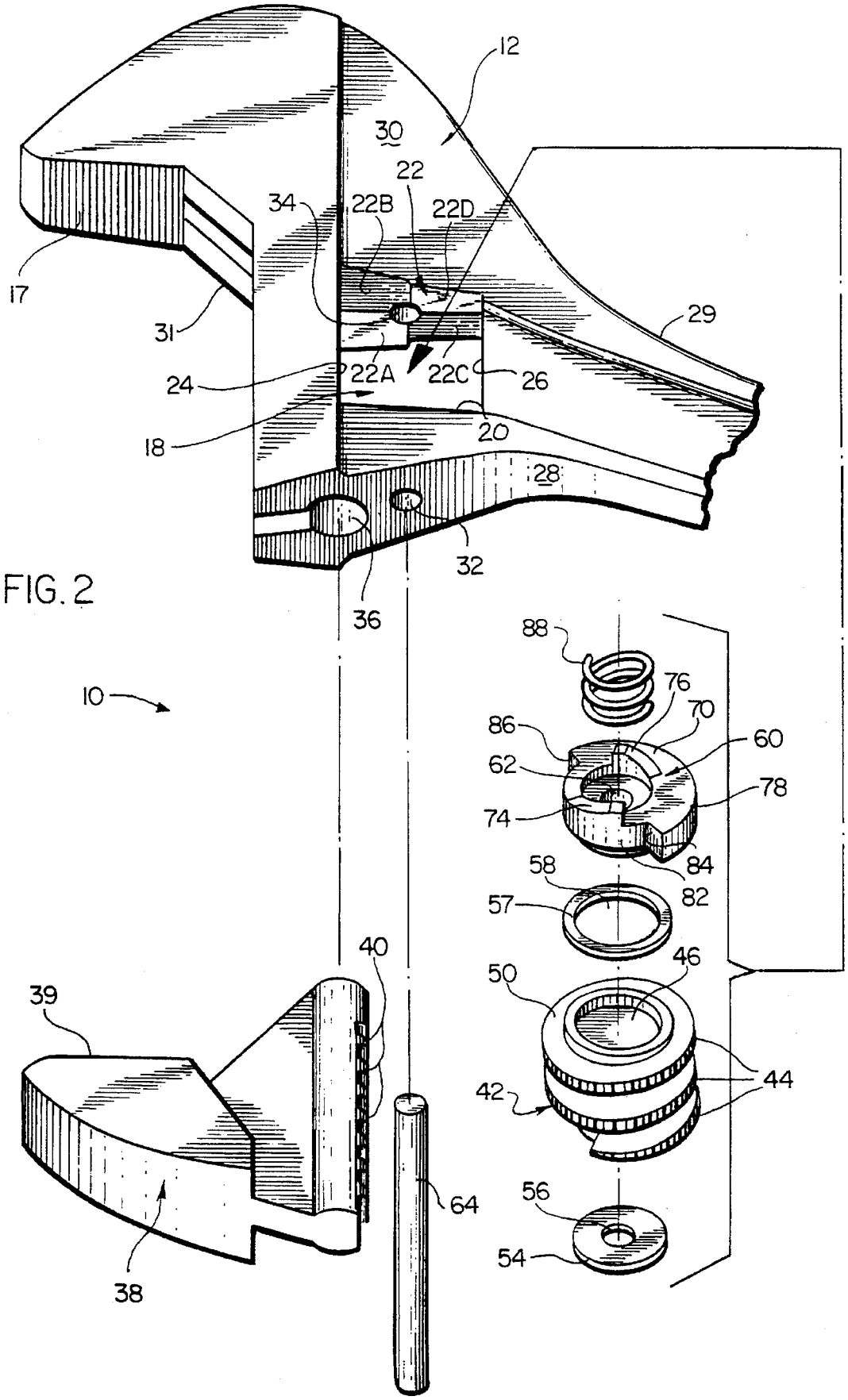
FIG. 2 is an enlarged, fragmentary, exploded, perspective view of the wrench of FIG. 1.

Referring to the drawings, an adjustable locking wrench 10 is provided. As discussed below, the wrench 10, has an unlocked condition, shown in FIGS. 3, 8 and 9, and a locked condition, shown in FIGS. 4–7. Referring to FIGS. 1 and 2, the wrench includes a wrench body 12. The wrench body 12 includes a handle 14 and a fixed jaw 16 having an engaging surface 17. As seen best in FIG. 2, the wrench body 12 also has a generally rectangular cutout 18 defined by first and second surfaces 20 and 22 and third and fourth surfaces 24 and 26 substantially perpendicular to the first and second surfaces 20, 22. The wrench body 12 also includes, as seen in FIGS. 1–4, a first side surface 28, a second side surface 29, a top surface 30 and a bottom surface 31. The wrench body 12, as seen in FIGS. 2 and 5 further includes a first bore 32 opening both at the first surface 20 of the cutout 18 and the first side surface 28. The wrench body 12 also has a second bore 34 opening at the second surface 22 of the wrench body 12. The first and second bores 32, 34 are coaxial. The wrench body 12 also includes a key-hole-shaped slot 36 having an axis substantially parallel to that of the bores 32, 34 and extending from the first side surface 28 to the second side surface 29 of the wrench body 12 and opening at the third surface 24 defining the cutout 18.

As discussed below in greater detail, the second side surface 22, as seen best in FIG. 2, is divided into four surface sections 22A, 22B, 22C and 22D which surround the opening of the second bore 34. Sections 22A and 22D are substantially coplanar surfaces substantially perpendicular to the axis of the bore 34. Sections 22B and 22C are inclined cam surfaces. Section 22B is sloped from a first end at the top surface 30 to a second end at the section 22A in a direction toward the first surface 20 so that the distance between section 22B and the first surface 20 decreases as one moves from the top surface 30 to the junction with section 22A (designated by line L). Likewise, section 22C is sloped from a first end at the bottom surface 31 toward the first surface 20 to a second end at the junction with section 22D (also illustrated by line L), so that the distance between section 22C and first surface 20 decreases as one moves from the bottom surface 31 to line L.

The adjustable locking wrench 10 also includes a movable jaw 38 mounted on the wrench body 12 and partially disposed in the slot 36. The movable jaw 38 includes an engaging surface 39 and rack teeth 40. As discussed below, the rack teeth 40 project through the opening of the slot 36 of the third surface 24 into the cutout 18 and engage the threads of a thumb-actuated adjuster worm gear 42 of an adjuster assembly 43 (FIG. 5) to move the engaging surface 39 of the movable jaw 38 toward and away from the engaging surface 17 of the fixed jaw 16 to vary the space between the engaging surfaces 17, 39 to match the size of an object to be clamped therebetween.

The adjuster worm gear 42 is disposed within the cutout 18 and is coaxially aligned with and rotatable about the common axis of the first and second bores 32, 34. As discussed above, the adjuster worm gear 42 has a plurality of threads 44 mateably engagable with the rack teeth 40 of the movable jaw 38 to convert the rotation of the adjuster worm gear 42 into linear axial movement of the movable jaw 38. The adjuster worm gear 42 also has an axial bore 46 therethrough and a first and second end surfaces 48, 50 substantially parallel to each other. The bore 46 also has a counterbore section 52 (FIG. 5) extending from the second end surface 50. The adjuster assembly 43 also includes a spacer 54 having an axial bore 56 disposed in the cutout 18 between the first surface 20 of the cutout 18 and the first end surface 48 of the worm gear 42 and a washer 57 having an axial bore 58 disposed in the cutout 18 next to the second end surface 50.

The wrench 10 also includes a locking disc 60 disposed in the cutout 18 between the washer 57 and the second surface 22 of the cutout 18 and is coaxially aligned with and rotatable with the common axis of the first and second bores 32, 34. The locking disc 60 has an axial bore 62 therethrough, and is a one-piece rigid construction usually made of a strong metal.

Figure 6:
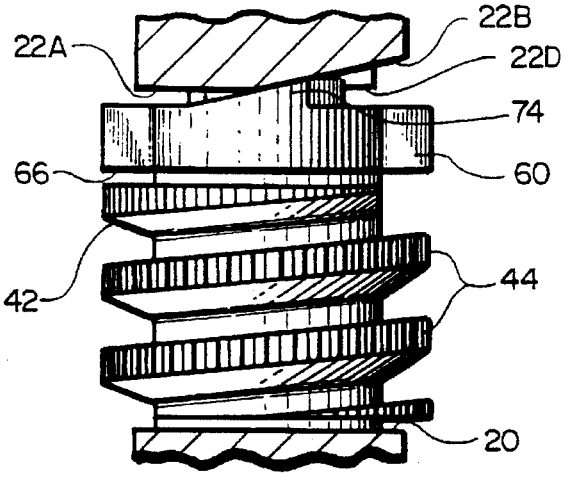
FIG. 6 is a fragmentary, sectional view taken generally along line 6—6 of FIG. 4.

As best seen in FIGS. 2 and 6, the wrench 10 also includes a pin 64. The pin 64 is disposed through the first bore 32, the axial bore 56 of the spacer 54, the axial bore 46 of the adjuster worm gear 42, the axial bore 58 of the washer 57, the axial bore 62 of the locking disc 60 and the second bore 34. The pin 64 is fixed to the first and second bores 32, 34 by conventional means so that it does not rotate or move axially. The pin 64 has a diameter slightly less than that of the bore 46 of the adjuster worm gear 42. This diameter allows the adjuster worm gear 42 to rest on and rotate freely clockwise or counterclockwise about the pin 64 when, as described below, the wrench 10 is in the unlocked condition and movable jaw 38 has not reached its limits of travel at fully open and fully closed positions. The fully open limit is typically imposed by the length of the rack on movable jaw 38. The fully closed limit is typically imposed when the engaging surface of movable jaw 38 meets the engaging surface 17 of the fixed jaw 16, or when the engaging surfaces 17 and the engaging surfaces 39 of movable jaw 38 make contact with opposite faces of an object to be clamped therebetween. When movable jaw 38 has reached a limit of travel and the wrench 10 is in the unlocked condition, adjuster worm gear 42 is free to turn in the direction which would move the movable jaw 38 towards the opposite limit of travel.

The locking disc 60 has a first side surface 66 facing the washer 57 and a hub 68 projecting outwardly from the first side surface 66 and disposed within the counterbore section 52 of the adjuster worm gear 42. The locking disc 60 also has a second side surface 70 facing the second surface 22. The bore 62 of the locking disc 60 has a counterbore section 72 extending from the second side surface 70. The locking disc 60 further includes two diametrically opposed inclined cam surfaces or ramps 74, 76 projecting outwardly from the second side surface 70 and adjacent to the counterbore section 72. The inclined cam surfaces 74, 76 of the locking disc 60 are, respectively, engageable with inclined cam surface sections 22B and 22C of the second surface 22 of the cutout 18 of the wrench body 12.

The locking disc 60 has a first semi-cylindrical finger-contacting side surface 78 with a plurality of notches 80 for aiding frictional engagement by a user's fingers or thumb. The locking disc 60 also has a second-semi-cylindrical side surface 82 which has a smaller radius than the first side surface 78 so that first and second shoulder surfaces 84, 86 are formed between the first and second side surfaces 78, 82.

As discussed above, the wrench 10, as seen in FIGS. 3, 8 and 9, has an unlocked condition, and, as seen in FIGS. 4–7, a locked condition. In the unlocked condition, the adjuster worm gear 42 is free to rotate to move the movable jaw 38 in one direction or another. In the locked condition, the adjuster worm gear 42 and the movable jaw 38 are prevented from moving.

Figure 4:
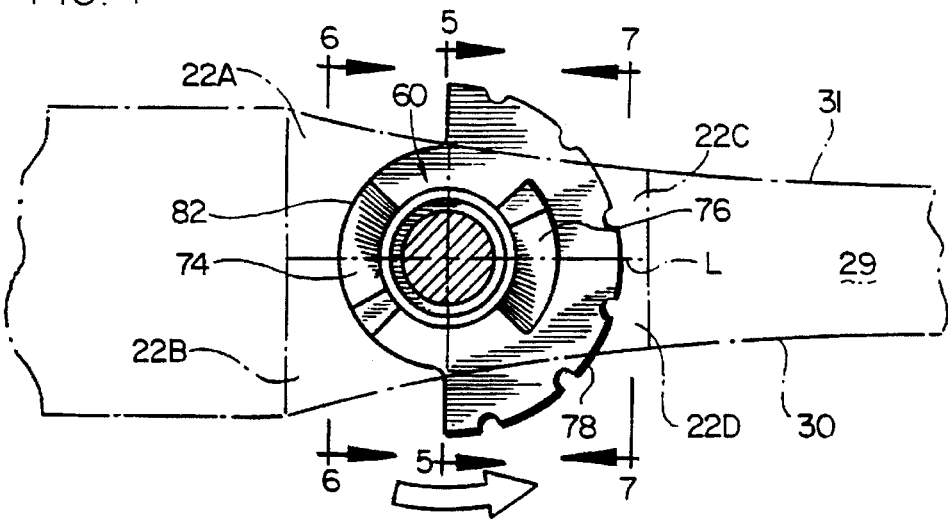
FIG. 4 is a view similar to FIG. 3 with the locking disc shown in the locked condition.
Figure 5:
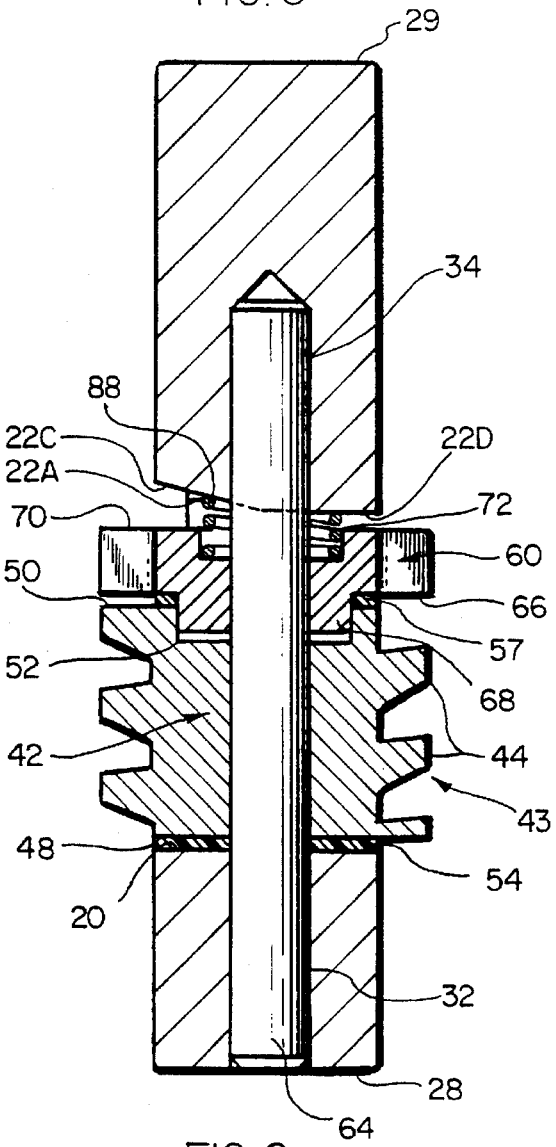
FIG. 5 is a sectional view taken along line 5—5 of FIG. 4.
Figure 7:
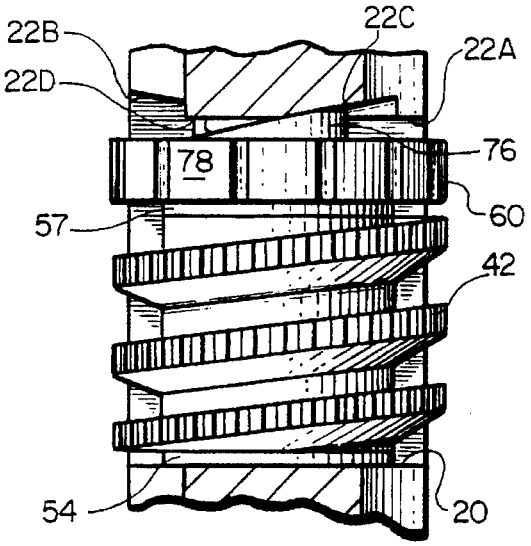
FIG. 7 is a fragmentary, sectional view taken generally along line 7—7 of FIG. 4.

When the locking disc 60 is rotated fully clockwise, as seen in FIG. 4, the inclined cam surface 74 contacts and engages inclined cam surface section 22B and inclined cam surface 76 contacts and engages inclined cam surface section 22C and axially forces the adjuster assembly 43 toward the first surface 20 of the body 12, so that the adjuster assembly 43 and the locking disc 60 are wedged between the first and second surfaces 20, 22 of the body 12 to prevent further rotation of the adjuster worm gear 42 and movement of the movable jaw 38, thereby placing the wrench 10 in the locked condition. Since the two inclined cam surfaces 74 and 76 are diametrically spaced apart, when they are engaged with cam surface sections 22B and 22C, they aid in providing a substantially constant wedging force to essentially the entire surface area of the washer 57 of the adjuster assembly 43, rather than exerting greater forces on portions of the washer. This placement of the inclined cam surfaces 74, 76 also prevents the locking disc 60 from canting or tilting so that the hub 68 of the locking disc 60 does not substantially frictionally engage the surface of the adjuster worm gear 42 defining the counterbore section 52, which could cause difficulty in rotating the locking disc 60 into and out of the locked condition.

Figure 3:
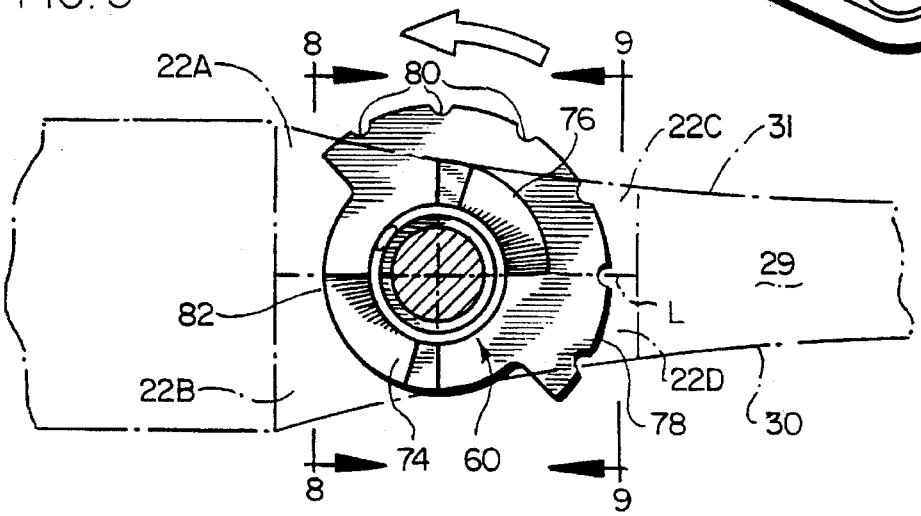
FIG. 3 is an enlarged, fragmentary, side elevational view of the locking disc of the wrench of FIG. 1 in the unlocked condition with a portion of the wrench body shown in phantom.
Figure 8:
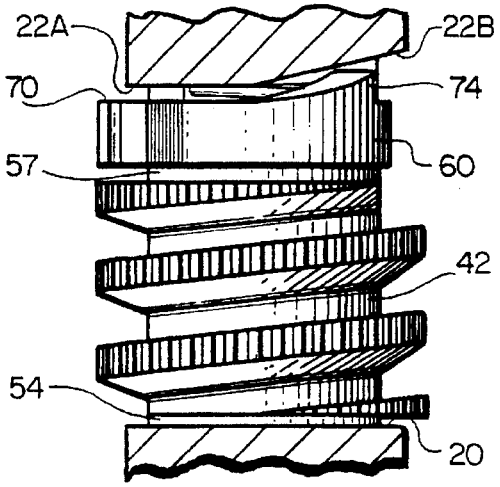
FIG. 8 is a fragmentary, sectional view taken generally along line 8—8 of FIG. 3.
Figure 9:
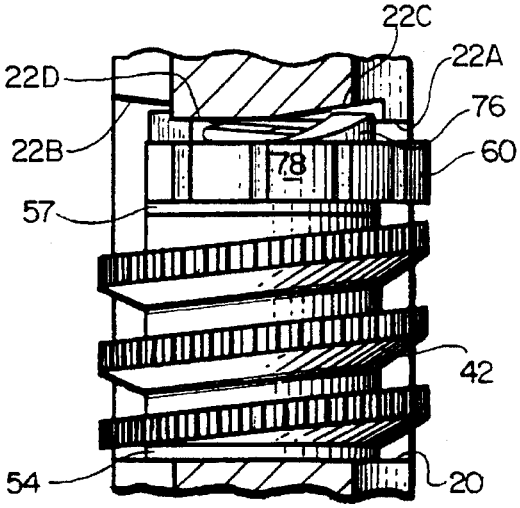
FIG. 9 is a fragmentary, sectional view taken generally along line 9—9 of FIG. 3.

The wrench 10 is typically used as follows: The locking disc 60 is rotated to an unlocked condition where the inclined cam surfaces 74 and 76 are not in contact with the inclined cam surface sections 22B, 22C of the second surface 22 of the body 12 and the adjuster worm gear 42 is free to rotate, as shown in FIGS. 3, 8 and 9. The user, with his thumb (or finger(s)), rotates the adjuster worm gear 42 to move the movable jaw 38 to the proper position to engage an object between the engaging surfaces 17, 39. After the movable jaw 38 has been properly positioned, the locking disc 60, as seen in FIGS. 4–7, is rotated clockwise in the direction of the arrow in FIG. 4 by, for example, a user placing the same thumb on the finger-contacting side surface 78 and moving the locking disc 60 to the locked condition. When the user wishes to alter the position of the movable jaw 38, he moves the locking disc 60 counterclockwise, in the direction of the arrow shown in FIG. 3, back to the unlocked condition and starts the jaw-adjustment process again. Thus, a user only needs one hand to adjust, lock and operate the wrench 10.

The wrench 10 also includes a spring 88 disposed about the pin 64 and seated in the counterbore section 72 and disposed between the locking disc 60 and the second surface 22 of the body 12. The spring 88 biases the locking disc 60 away from the second surface 22 to prevent contact between the two and to allow free rotation of the adjuster worm gear 42 when the wrench 10 is in the unlocked condition. The spring also reduces "play" in the axial movement of the movable jaw 38.

The washer 57, which is disposed between and prevents substantial contact between the locking disc 60 and the worm gear 42, is made of a material with a low coefficient of friction. This prevents rotation of the locking disc 60 when the worm gear 42 is rotated, so that the locking disc 60 is not accidentally placed in the locked condition which will not allow the wrench 10 to be properly adjusted. Likewise, washer 57 also prevents rotation of the worm gear 42 when the locking disc is rotated, which would cause the movable jaw 38 to move and place the wrench 10 out of its properly adjusted position. Alternatively, washer 57 may be replaced by a smaller diameter washer disposed in counterbore section 52 of the worm gear 42 and next to the hub 68 of the locking disc to prevent rotation or the worm gear 42 by the rotation of the locking disc 60, or vice versa. Alternatively, it is believed that the washer 57 may not be necessary and that the outer surfaces of the locking disc 60 and the worm gear 42 may be coated with a material having a low coefficient of friction.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. An adjustable wrench having locked and unlocked conditions, the wrench comprising:

a wrench body including a fixed jaw;

a movable jaw slidably mounted on the wrench body;

the wrench body having first and second contact walls, the second contact wall having a wall cam surface;

an adjuster assembly including a worm gear on the body between the contact walls and threadedly engaged with the movable jaw for moving the movable jaw toward and away from the fixed jaw, the worm gear having an axis;

a locking disc disposed between the worm gear and the second contact wall and having a disc cam surface engagable with the wall cam surface of the second contact wall, the locking disc being rotatable by a user's finger between the locked and unlocked conditions, the disc cam surface engaging the wall cam surface in the locked condition for wedging the adjuster assembly and the locking disc between the first and second contact walls to substantially prevent rotation of the worm gear and movement of the movable jaw, the locking disc in the unlocked condition releasing the disc cam surface from engagement with the wall cam surface so that the worm gear is free to rotate; and structure for preventing axial movement of the worm gear when the locking disc is rotated from the unlocked to the locked condition.

2. The wrench of claim 1, and further comprising means to prevent rotation of the worm gear when the locking disc is rotated.

3. The wrench of claim 2, wherein the rotating prevention means includes a washer having a low coefficient of friction disposed between the worm gear and the locking disc.

4. The wrench of claim 1, wherein the locking disc includes a second disc cam surface and the second contact wall has a second wall cam surface engagable with the second disc cam surface, the locking disc in the locked condition forcing the second cam surface of the locking disc against the second cam surface of the second contact wall to wedge the adjuster assembly and the locking disc between the first and second contact walls to substantially prevent rotation of the adjuster worm gear and movement of the movable jaw, the locking disc in the unlocked condition releasing the second cam surface of the disc from engagement with the second cam surface of the second contact wall so that the adjuster worm gear is free to rotate.

5. The wrench of claim 4, wherein the locking disc has a wall facing surface facing the second contact wall and the first and second disc cam surfaces are respectively defined by first and second inclined disc ramps projecting from the wall-facing surface.

6. The wrench of claim 5, wherein the first and second inclined ramps are diametrically spaced apart.

7. The wrench of claim 5, wherein the first and second wall cam surfaces are respectively defined by first and second inclined wall surfaces.

8. The wrench of claim 7, wherein the first inclined wall surface has first and second surface ends and slopes from the first surface end to the second surface end so that the distance between the first surface end of the first inclined wall surface and the first contact wall is greater than the distance between the second surface end of the first inclined wall surface and the first contact wall.

9. The wrench of claim 8, wherein the second inclined wall surface has first and second surface ends and slopes from the first surface end to the second surface end so that the distance between the first surface end of the second inclined wall surface and the first contact wall is greater than the distance between the second surface end of the second inclined wall surface and the first contact wall.

10. The wrench of claim 9, wherein the wrench body has a top surface and a bottom surface and the first surface end of the first inclined wall surface is at the top surface and the first surface end of the second inclined wall surface is at the bottom surface, and the second surface ends of the first and second inclined wall surfaces are disposed between the top and bottom surfaces of the wrench body.

11. The wrench of claim 1, and further comprising a shaft disposed between the first and second contact walls, wherein the worm gear and the locking disc are journaled on and rotatable about the shaft.

12. The wrench of claim 1, wherein the locking disc is a rigid body.

13. The wrench of claim 1, wherein the structure includes a spring disposed between the second contact wall and the worm gear.

14. The wrench of claim 2, wherein the structure includes a spring disposed between the second contact wall and the worm gear.

15. An adjustable wrench having locked and unlocked conditions, the wrench comprising:

a wrench body including a fixed jaw;

a movable jaw slidably mounted on the wrench body;

the wrench body having first and second contact walls, the second contact wall having a plurality of wall cam surfaces;

an adjuster assembly including a worm gear on the body between the contact walls and threadedly engaged with the movable jaw for moving the movable jaw toward and away from the fixed jaw;

a locking disc disposed between the worm gear and the second contact wall and having a plurality of disc cam surfaces, each disc cam surface being engagable with one of the wall cam surfaces of the second contact wall, the locking disc being rotatable by a user's finger between the locked and unlocked conditions, each disc cam surface engaging one of the wall cam surfaces in the locked condition for wedging the adjuster assembly and the locking disc between the first and second contact walls to substantially prevent rotation of the worm gear and movement of the movable jaw, the locking disc in the unlocked condition releasing the disc cam surfaces from engagement with the wall cam surfaces so that the worm gear is free to rotate; and structure for preventing axial movement of the worm gear when the locking disc is rotated from the unlocked to the locked condition.

16. The wrench of claim 15, and further comprising means to prevent rotation of the worm gear when the locking disc is rotated.

17. The wrench of claim 16, wherein the rotating prevention means includes a washer having a low coefficient of friction disposed between the worm gear and the locking disc.

18. The wrench of claim 15, and further comprising a shaft disposed between the first and second contact walls, wherein the worm gear and the locking disc are journaled on and rotatable about the shaft.

19. The wrench of claim 15, wherein the locking disc is a rigid body.

20. The wrench of claim 15, wherein the structure includes a spring disposed between the second contact wall and the worm gear.

21. The wrench of claim 16, wherein the structure includes a spring disposed between the second contact wall and the worm gear.

* * * * *